US009694370B1

(12) United States Patent
Shoemaker

(10) Patent No.: US 9,694,370 B1
(45) Date of Patent: Jul. 4, 2017

(54) SHOWER CONTROL

(71) Applicant: David P. Shoemaker, Durham, PA (US)

(72) Inventor: David P. Shoemaker, Durham, PA (US)

( * ) Notice: Subject to any disclaimer, the term of this patent is extended or adjusted under 35 U.S.C. 154(b) by 620 days.

(21) Appl. No.: 14/015,839

(22) Filed: Aug. 30, 2013

Related U.S. Application Data

(60) Provisional application No. 61/694,815, filed on Aug. 30, 2012.

(51) Int. Cl.
*A47K 3/00* (2006.01)
*B05B 1/18* (2006.01)

(52) U.S. Cl.
CPC ..... *B05B 1/185* (2013.01)

(58) Field of Classification Search
CPC ..... A47K 3/281; B05B 1/185
USPC ..... 4/605
See application file for complete search history.

(56) References Cited

U.S. PATENT DOCUMENTS 3,112,073 A 11/1963 Larson et al.
4,273,289 A 6/1981 Jette
4,282,612 A 8/1981 King
4,311,279 A 1/1982 Jette
4,360,160 A * 11/1982 Jette ..... B05B 1/3026 239/289
4,398,668 A 8/1983 Jette
4,881,282 A 11/1989 George et al.
5,220,697 A * 6/1993 Birchfield ..... A47K 3/281 16/426
5,329,651 A 7/1994 Marder et al.
D360,022 S 7/1995 Smith
5,499,767 A 3/1996 Morand
6,315,220 B1 11/2001 Grubb
6,474,621 B1 * 11/2002 Vogel ..... E03C 1/041 137/382
6,618,872 B1 9/2003 Fan
7,694,359 B1 * 4/2010 Hall ..... E03C 1/0408 239/581.1
8,366,025 B2 * 2/2013 Cheng ..... B05B 1/1609 239/443
2005/0283904 A1 * 12/2005 Macan ..... E03C 1/066 4/615

* cited by examiner

*Primary Examiner* — Lauren Crane
(74) *Attorney, Agent, or Firm* — Charles A. Wilkinson; Clinton H. Wilkinson

(57) ABSTRACT

An economical shower conversion arrangement for enabling physically challenged persons to shower while seated without assistance embodying a showerhead mount including a pivotable control arm or handle connected to the showerhead assembly which arm is securable in multiple use positions so as to be easily reached and operated by a person seated in a shower chair to adjust the direction of water flow from the showerhead by application of a manual force upon the arm, which arm may be pivoted into a non-use position that does not obstruct use of the shower by non-disabled or standing persons, and including an adjustable balance support to aid in controlling the handle assembly while reducing the amount of stress on the pipe connections and fittings.

13 Claims, 9 Drawing Sheets

SHOWER CONTROL

CROSS REFERENCE TO RELATED APPLICATION

This application claims the benefit of U.S. Provisional Patent Application Ser. No. 61/694,815 filed on Aug. 30, 2012, the entirety of which is hereby incorporated by reference.

BACKGROUND OF THE INVENTION

1. Field of the Invention

This invention relates generally to shower arrangements, and more particularly to controls for showers usable by the disabled and particularly by persons who must be seated while showering.

2. Preliminary Discussion and Description of Related Art

Showering rather than taking baths has become the norm for the American public to the extent that one almost never, or, at least, hardly ever, hears an individual state "I took a bath" or "I am going to take a bath". Instead the speaker almost invariably states "I took a shower" or "will take a shower". Showers are now indeed ubiquitous with the American public. Yet, for those who are physically handicapped by leg, hip, balance or certain neurological impediments preventing them from standing and from moving around sufficiently or sufficiently easily to expose various portions of their body to the spray of water from a showerhead or shower installation, or who are too unsteady on their feet or slow to recover their balance after a minor slip or unsteadiness, the process of showering can be formidable unless such persons have the aid of another party such as a mate, relative, nursing aid or the like.

Yet many, if not most, disabled persons prefer, like nearly everyone else, to shower in private, even though they may have difficulty in getting into or out of the shower installation, particularly where as in most older homes the shower is a combined full bathroom facility in an upstairs location, frequently attached to a master bedroom or in a downstairs bathroom or the like. In some cases, there may not be room for a disabled person to be able to sit down in a plastic chair or on other specially designed shower seat of a type available on the market (usually placed on the bottom surface of a tub, straddling the sides of the tub, or the like) to facilitate bathing by the disabled, preferably by showering. Even further, if the disabled person is unable to stand without aid, either due to lack of strength, lack of balance or disabling injuries to their legs and hips or back, they have no alternative but to sit during showering. Otherwise, an aid must be present to help support them in a standing position while showering, which, as pointed out above many persons consider an invasion of privacy and demeaning because it is an indication of a severe lack of independence, not to mention difficult for the person aiding the disabled in showering. Having another present during the actual process of showering also removes a large part of the usual relaxation and mental stimulation attained when showering as the result of massage of the body surface by stimulating hot liquids.

The usual shower installation is designed for use by persons standing in the shower, with the attainable angle of the showerhead being adapted for best spraying water on the body of an individual standing upright. In addition, the controls of the shower are usually secured to the wall of the shower stall in a position for use by a standing individual. An individual seated in a shower is not positioned, therefore, to readily reach or operate the controls or adjustments of a shower in the typical American shower installation. Furthermore, a seated individual who is disabled is not able to easily twist or turn his or her body to encourage the shower spray to be directed at substantially all parts of at least of his or her upper body.

This last problem mentioned above, i.e. directing the shower spray at all parts of the body, is often not as severe for continued use of a shower installation in many other countries as in the United States, since many foreign shower installations, including most European shower installations, are provided with a hand-held showerhead attached to a hose which the user can readily direct to different parts of his or her body. However, the American public is habituated to the use of directionally adjustable, but basically stationary, showerheads mounted on the wall under which the one taking the shower moves to catch the spray of water on various parts of the body. Furthermore, a salient feature of disabled persons and particularly newly disabled persons, which includes those disabled by reason of age, is that such persons prefer to maintain their life as much like their former active state as possible. Thus, while a European or continental hand-held showerhead arrangement could be installed at some expense for the disabled and otherwise physically challenged, and other family members would usually adjust to it, the disabled themselves prefer to maintain their shower installations as much like before as possible and in the United States this involves the usual wall mounted shower head.

As a result of the above considerations, a number of inventors have worked on providing shower arrangements for the disabled including or among which can be noted the patented inventions set forth below. Many of these prior arrangements are difficult for both disabled persons and non-disabled persons to use correctly and consistently. The present inventor, therefore, has developed a pivoting arm arrangement that can be readily attached to a standard showerhead or nozzle structure, which pivoting arm can be easily grasped by a disabled person seated in the shower installation and used to adjust and direct the showerhead to change the direction of the shower spray to reach various parts of such seated disabled person's body, but which pivoting shower adjustment arm can also be pivoted down out of the way of a non-disabled person using the same shower installation. In more advanced embodiments of the invention, the pivoting arm shower control is provided with further control means such as a rotary knob controlling the spray of the showerhead and the relative flow of hot and cold water, the latter being particularly important if there are other users of water in the household such as for flushing toilets, operating clothes or dishwashers or the like at the same time and if a hot water tank-type system is used, and the water may gradually become colder during use in contra distinction to the operation or the intended operation of a demand-type hot water system. In addition, in some embodiments the force of the shower can be varied as well as the force of the water spray adjusted by the same hand controls.

As a result of use of the present invention, a second person need only initially place a plastic or other light chair in the shower if the disabled person is unable to do so, and then aid the disabled showerer into and out of the shower if this is too much for the showerer. Known shower installations for the disabled also frequently have the disadvantage that the controls provided for use by a disabled person are inconvenient for nondisabled persons, so that the convertibility of the shower between use for those who may be disabled and those who may be less physically challenged may be less than desirable. When the arrangement of the present invention is available, in fact, some non- or less-physically challenged persons may prefer to shower while seated using the installation of the invention.

3. Prior Art Known to the Inventor

The inventor is aware of the following patents relating to shower incorporating control arms and/or designed especially for the disabled:

U.S. Pat. No. 3,112,073 issued to C. B. Larson et al. on Nov. 26, 1963, entitled "Flexible Spot Rinsing Head for Shower Baths", discloses a shower head having a standard nozzle and further having separately connected a flexible hose for spot washing or rinsing. A short handle (33) having forward, up, back, and down positions is provided wherein the water supply either flows through the standard nozzle, spot washing hose, both, or neither. Such handle is quite short, however, and clearly is not intended to be reached by a handicapped person who is unable to stand while taking a shower.

U.S. Pat. No. 4,273,289 issued to E. Jette on Jun. 16, 1981 entitled "Showerhead Spray Texture Control", discloses a showerhead wherein the flow of water, direction of spray, and spray texture may be controlled using an elongate rod. The flow or water supply into the showerhead and through a discharge port may be shut off or turned on depending on the angle of the showerhead in relation to the discharge port. A ball structure is provided on the end of the handle which is separate from the elongate rod and includes a sleeve over such rod. The sleeve has a gear on its upper end that is connected to a ring gear on the showerhead, which allows the spray texture to be controlled by turning of the ball.

U.S. Pat. No. 4,282,612 issued to J. L. King on Aug. 11, 1981, entitled "Adjustable Shower and Massage Apparatus", discloses an arrangement that allows the direction of spray emitted from a shower head to be adjusted using a handle means. A plurality of pipe members is pivotally connected together extending generally vertically, with a massage type shower head connected to one pipe member, and a handle member connected to a lower pipe member. Movement of the handle causes the angles of the pipes to be adjusted through universal adjustable joints between the individual pipe members, thereby causing the spray angle to also in turn be adjusted.

U.S. Pat. No. 4,311,279 issued to E. Jette on Jan. 19, 1982, entitled "Water Flow Control Device for a Showerhead", is a continuation-in-part application of the '289 Jette patent, and is directed to an alternative showerhead water flow control arrangement. A fitting is threadably connected to the water supply line, a tubular center portion having a swivel means connects the fitting to the showerhead, and a control rod is connected to the fitting. The rod has a valve therein which is aligned with the new main water flow passage through the fitting. By moving the control rod so that it is either aligned or misaligned with the main water flow passage, the rate of water flow may be controlled. As in the earlier Jette patent the handle can also be used to determine the direction or position of the showerhead.

U.S. Pat. No. 4,398,668 issued to E. Jette on Aug. 16, 1983, entitled "Showerhead Control" is another continuation-in-part application of the previous Jette patents, and discloses a showerhead having a downwardly extending handle connected thereto. This invention includes a shower arm connected to a water supply, a ball valve connecting the shower arm to a showerhead, and a handle connected to the ball valve. Movement of the handle may be used to adjust water flow direction and temperature as well as to shut off the water flow.

U.S. Pat. No. 4,881,282 issued to E. J. George et al. on Nov. 21, 1989, entitled "Adjustable Shower Head", discloses a shower head adjustment means specifically for use by the handicapped. The device is operated by a joystick mounted in the shower assembly within easy reach of one seated in the shower stall, and which joystick is connected to the showerhead by a cable means. Movement of the joystick causes the shower head to move in a like direction as the joystick via four control cables, which are connected to a yoke or panel in the joystick housing.

U.S. Pat. No. 5,220,697 issued to W. T. Birchfield on Jun. 22, 1993, entitled "Handle Assembly for Shower Nozzle Assembly", discloses a shower handle assembly for use by handicapped persons in a shower stall to adjust the height of a shower nozzle, which may be either retrofitted to an existing shower nozzle or used with a new shower nozzle assembly. Birchfield connects a handle assembly over a clamp to a vertically adjustable shower assembly so that one seated on a chair in the shower stall can use the handle to loosen, reposition, and retighten the shower nozzle assembly at a new desired vertical position. Birchfield's invention is not intended to be used to adjust the angle of the spray emitted from the shower nozzle, but rather to adjust the height of the nozzle assembly.

U.S. Pat. No. 5,329,651 issued to S. G. Marder et al. on Jul. 19, 1994, entitled "Bathing Apparatus for the Infirm", discloses a shower stall unit specifically arranged to be easily used by the infirmed or elderly including various handles, a seat, a pivotable support bar, and a shower nozzle connected to a hose at a fairly low height. The shower nozzle arrangement includes a swivel mounted on a support member, a handle, a shower mast and a nozzle. Moving the handle and swivel member causes the spray nozzle to move rearwardly and forwardly in relation to the bather, enabling the bather to rinse his or her entire body without physically moving around. Marder incorporates a continental-type of hand-held showerhead into an overall arrangement for bathing elderly or inferior persons.

U.S. Pat. No. 5,499,767 issued to M. Morand on Mar. 19, 1996, entitled "Shower Head Having Elongated Arm, Plural Nozzles, and Plural Inlet Lines", discloses a showerhead having an elongated arm attached thereto with a swivel joint connected to the back of the arm, and the showerhead connected to the front of the arm. Spray from the nozzle can be directed by grasping the lower end of the arm near and then pivoting and/or tilting the arm about the swivel joint. In another embodiment, a control valve is provided in the arm for turning the water on and off, a second shower nozzle is provided on the bottom end of the arm, and a third nozzle is provided in the middle of the arm. A variable spray arrangement is also disclosed.

U.S. Pat. No. 6,315,220 issued to T. L. Grubb on Nov. 13, 2001, entitled "Method and Apparatus for Converting a Faucet to a Hand-Held Shower", discloses a flexible hose apparatus which is connected to a shower head so that it may be used as a hand-held shower rather than a conventional shower. Grubb thus basically attaches a continental showerhead attachment for an American shower system.

U.S. Pat. No. 6,474,621 issued to J. Vogel on Nov. 5, 2002, entitled "Water Control Apparatus for Showers", discloses a valve assembly connected between a showerhead and a water source and also including a downwardly extending operating means in the form of a rod for adjusting the flow of water without using the conventional hot and cold taps. Vogel claims that this arrangement conserves water by decreasing wasted water during use, and generally discloses a downwardly extending handle connected to a shower assembly for adjusting the amount of spray, rather than the direction of the spray.

U.S. Pat. No. 6,618,872 issued to C. Fan on Sep. 16, 2003, entitled "Controlling Device for a Showerhead", discloses a shower head including a push valve, a controlling valve, and a collar for aiding a short person or child in controlling the shower head. The showerhead assembly has a first water outlet leading to a shower nozzle and a second outlet leading to a water dispenser. The push rod is used essentially to control the path of water into either the first outlet or second outlet. While the Fan reference teaches a downwardly extending control rod connected to a shower assembly, the rod is not used to change the direction or angle of the spray emitted from a shower nozzle, but rather to control the path of the water through the shower assembly.

U.S. Design Pat. No. 360,022 issued to L. A. Smith on Jul. 4, 1995, entitled "Combination Bathtub and Shower Unit and Seat for Handicapped and Elderly Persons", shows an ornamental design for a shower assembly having a seat and a manual shower hose.

None of the aforementioned prior art or any other prior art with which the present inventor is familiar includes the use of an extended pivoting rod or handle which may be used to control in one embodiment the direction of the water issuing from the showerhead and in another embodiment the force of such water and preferably also the temperature of such water. Nor are there any arrangements which can be easily and inexpensively substituted for or attached to an existing shower system.

OBJECTS OF THE INVENTION

It is an object of the invention, therefore, to provide an extended arm attached to a showerhead in a shower for operation by the physically challenged including the elderly or disabled which can be grasped by the person using such shower from a seated position to control the direction of the showerhead and therefore the direction of the shower water, and which can be pivoted downwardly out of the way when the shower is to be used by others.

It is a still further object of an embodiment of the invention to provide a shower assembly having an elongated showerhead attachment arm for use by the elderly, physically challenged or disabled that can also be used conveniently by non-disabled persons by simply pivoting the control arm out of the way.

It is a still further object of and embodiment of the invention to provide a shower assembly which can be easily substituted for an existing showerhead installation and provide convenient effective showering by disabled, elderly or otherwise physically challenged persons in private while seated as well as by a non-disabled person standing in the shower in a normal position.

It is a still further object of an embodiment of the invention to provide a shower assembly incorporating an extended handle which enables the user not only to adjust the direction of the showerhead, but also the force or temperature of the shower water.

It is a still further object of an embodiment of the invention to provide an elongated arm for attachment to a showerhead which is capable of being set in a plurality of use positions.

It is a still further object of an embodiment of the invention to provide a showerhead attachment arm having a plurality of attachment points reducing the pulling and sheering forces placed on the outlet pipe to which the shower assembly is connected.

It is a still further object of an embodiment of the invention to provide a showerhead attachment arm assembly including a wall bracing member to facilitate prevention of the outlet pipe from being pulled in relation to the shower stall wall.

Other objects and advantages of the invention will be evident from review and study of the following designation in confirmation with the appended drawings.

BRIEF DESCRIPTION OF THE INVENTION

A showerhead adjustment arrangement is provided featuring an extended directional adjustment handle for allowing the direction of the showerhead and, therefore, the spray direction issuing from said showerhead, to be adjusted by a person seated in the shower, the handle being sufficiently long or extended to be easily graspable by a physically challenged person who finds it either necessary or desirable by reason of being elderly or otherwise disabled or partially disabled to shower from a seated position in a shower, but which handle can be pivoted out of the way when the shower is used by a more physically normal person. In an embodiment, the showerhead can also be adjusted with respect to the volume of the flow of the shower water including complete shut off through the extendable handle and in a further improvement the temperature or mixing of the water can be adjusted for temperature control. The extended handle is made such that it will remain extended while being used by a disabled person, but can be swung away when such shower is used by another.

DESCRIPTION OF THE PREFERRED EMBODIMENTS

Figure 1:
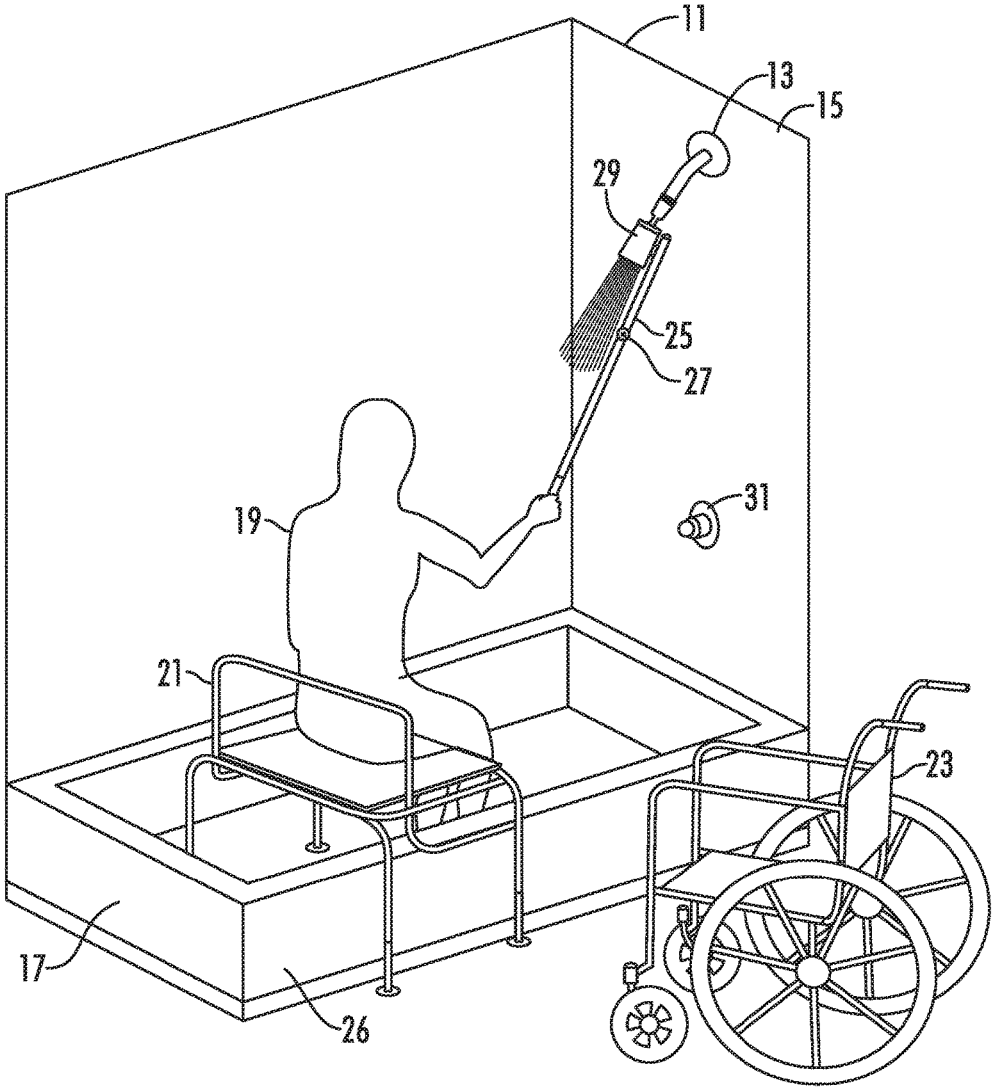
FIG. 1 is an isometric view of a shower installation incorporating an embodiment of the showerhead control handle of the invention.

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention.

Elderly, disabled or otherwise physically challenged individuals who cannot stand either at all or who are unsteady and cannot stand and move securely in a shower or a tub equipped with a shower whether by reason of physical weakness or because of diminished balance are usually forced to sit on a stool or a chair of some sort in the shower enclosure. However, in a sitting position such persons frequently cannot reach the usual controls of a shower, and as a result must rely upon others to adjust the shower controls or risk falling in attempting to adjust them themselves. Almost all persons, however, value their privacy and independence when bathing and do not like to be hovered over by aides of any nature particularly in the usual nude condition necessary for showering. Taking a shower, moreover, is one time when most individuals enjoy relaxing alone with their own thoughts while having their body and mind stimulated by the pleasurable feel of water flowing over it. The elderly, incapacitated and otherwise physically challenged, furthermore, value highly anything that aids or preserves their independence, such as walkers, scooters for the elderly and disabled, lift chairs and the like, but even more valued is being able to tend to their own physical requirements such as eating and washing and last if certainly not least "going to the bathroom" or attending to important elimination functions. Being able to attend unaided to these needs truly does wonders for the attitude and peace of mind of such persons.

As a result, there have been various inventions and developments to aid the elderly, disabled and physically challenged to bathe and shower safely and conveniently such as hand hold bars on the sides of tubs, non-slip mats and other surfaces in the tubs, and arrangements by which the shower water can be controlled by one seated in a shower which is typically arranged in connection with a tub. Such installations are frequently not inexpensive and frequently also render the shower installations unsuitable for normal users. It is the present inventor's aim, therefore, to provide a shower attachment which is both inexpensive and effective to allow a shower user seated on a chair or on a stool in a shower to directionally align the showerhead to direct the water spray over his or her whole body in increments, allowing such person to soap or lather other parts of his or her body by moving the angle of the showerhead by means of an arm or extended handle clamped to the showerhead away from the body part or area being lathered and then redirected at such body part or area to wash away the soap or lather. In addition, the arm or handle is pivoted between one or more use positions and a nonuse position to allow it to be swung out of the way of a person who is able to stand to take a shower in the same installation without any modification.

In one embodiment of the invention, the pivoted arm may be provided with a central movable section or a separate flexible member may be attached thereto which can serve to adjust the showerhead for different types of spray, and in another embodiment such central section can be arranged by suitable mechanical linkages to adjust the temperature of the shower water, all of such adjustments being arranged to operate through the pivoted handle without interfering at all with the normal use of the shower controls by one not physically challenged or incapacitated from taking stand-up showers. The adjustment arm of the invention in another embodiment may be provided as a clamp-on arrangement to be clamped upon a normal showerhead. However, in a preferred embodiment the adjustment arm is provided as a replacement unit for the actual showerhead incorporating a built-in pivoted adjustment lever attached to the showerhead. Movement to the side of the showerhead may in an embodiment effect a complete shut-off of the water flow.

Use of the invention provides a simple and practical method for one seated upon a chair or stool in a shower in one embodiment to both turn on the shower themselves after being once seated in the shower and to turn off the shower when their private ablutions, or washing, is complete prior to opening the shower curtain or enclosure preparatory to obtaining the aid of another to physically leave the shower area. The pivoted shower handle will further allow the shower handle to hang down out of the way when not being used to control the shower direction and water flow.

In another embodiment, an additional rotatable rod may pass through the handle and interengage with a circular rack and pinion arrangement on the exterior of the water spray plate of the shower such that turning of the rod in the handle by a knob or other grip on the end of such rod will adjust the spray pattern by moving the relative position of the spray head with a second stationary spray head plate.

In still another embodiment of the invention a pivoted handle may be clamped by means of metal straps or adjustable basket means to a regular shower head to provide a means for directional control by the shower occupant but without the preferred shut off capability of more sophisticated embodiments of the shower installation of the invention.

In FIG. 1 there is shown an isometric view of a tub type enclosure 11 in which a shower installation 13 is mounted on a wall 15 partially surrounding a tub 17. It will be understood that a shower curtain or a sliding door enclosure well known in the art will usually be mounted along the otherwise open side or sides of the tub to limit shower spray beyond the confines of the tub or shower area or enclosure, but which curtain or door arrangement is not shown in FIG. 1 for convenience of illustration. A showering individual 19 is shown seated on a light seating device or chair 21 placed in the tub 17. It will be understood that an aide of some nature, such as a family member, neighbor, nurse or the like not shown, has probably, but not necessarily, helped the individual 19 into the tub 17 and will aid him or her in egression or leaving the tub and shower enclosure. While in the tub-shower installation, however, the individual can usually be left completely to his or her own resources in washing, initially turning the shower on in the present embodiment by moving a shower arm 25, shown in FIG. 1 being grasped by the individual 19, from the entrance side 26 of the tub 17 to a central position over the tub 17 as shown and consequently opening the simple valve incorporated in the interior of the showerhead 29 as illustrated in greater detail in FIGS. 4 through 8 described hereinafter, which preferably replaces or overrides the normal shut off valves and mixing arrangement valve 31. Such main mixing and control valve 31 will be initially adjusted by the aide, leaving the activation of the shower and the particular aiming of the showerhead to the showering individual through the shower arm 25. The shower control arm 25 may be used by the showering individual 19 to control the movement of the showerhead 29 and direct the water spray from side to side and up and down so that essentially all positions of the body of the seated individual 19 can be reached by shower water. Preferably the seat of the light seating device or chair 21 will be of a construction which will allow water to reach the posterior of the individual if not by a direct spray, at least by a run off flow of moisture.

Figure 2:
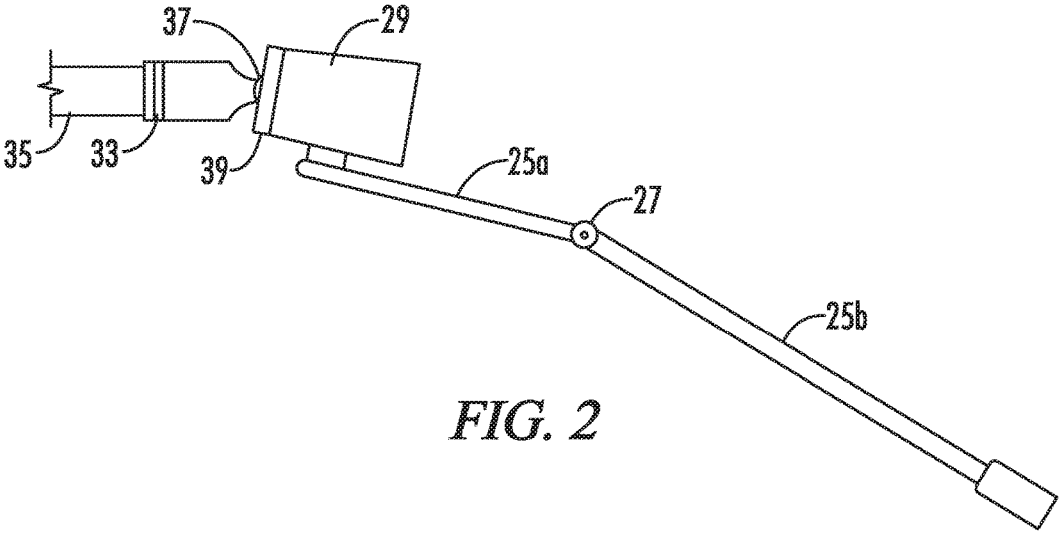
FIG. 2 is a larger isometric view of the showerhead control handle of the invention shown in FIG. 1 in an operating position.

The control arm 25 of the shower installation will be placed in the hand of the showering individual 19 when first seated in the shower. As is best illustrated in FIG. 2, control arm 25 will be preferably pivoted at a central joint 27 such that two parts or sections, namely inner section 25*a* and outer section 25*b* are formed and will be pivotable with respect to each other in only one place so that ready control of the position of the showerhead by a seated individual can be attained. Depending upon the height of the seated individual and how far he or she is seated from the showerhead, he or she will be able to grasp the arm and easily move it from side to side or up and down with the shower arm either straight or partially bent at a central joint 27. The outer section 25*b* of the control arm or shower arm 25, furthermore will be pivotable at a point so that it can be pivoted downward to a substantially vertical downward position out of the way of a normal standing showering individual. The pivot point of control arm 25, therefore, in the presently described embodiment will normally be at a location about one quarter to one third of the distance from the top where connected to the showerhead. The shower arm 25 is attached by mounting 49 to the showerhead 29 on the underside of such showerhead so that the showerhead 29 can be moved by use of the control arm 25 when such arm is moved, but will not interfere with the flow of the shower spray when folded down during use of the shower by a standing individual taking a shower.

The construction of the presently described showerhead and showerhead arm embodiment is shown in FIGS. 2 through 9, in which a shower coupling 33 is shown connected to a shower supply pipe or water conduit 35 extending usually from the nearest wall. The shower coupling 33 has fixed to the end opposite conduit 35 either integrally or as a separate piece, a shower ball 37 which is grasped or partially encompassed by an internal socket 41 in the rear end of the showerhead 29 in combination with a retainer 39 threaded on to the rear of the showerhead 29. An expanded opening is provided in the rear of the retainer 39, threaded upon the showerhead 29 to allow it to be universally inclined usually about twenty to thirty degrees with respect to or about the shower ball 37. The shower coupling 33 incorporates a connecting pipe section 46 extending from the shower coupling 33 to and mounting shower ball 37 on the end with an internal water conduit or passage 47 leading through the pipe section from the shower coupling to the surface of the shower ball opening into the internal water chamber 45 within the showerhead 29. A perforated shower disk 43 provides a screen at the end of the shower head 29 to partially close off the diverging water chamber 45 within the showerhead, which water chamber 45 supplies shower water under pressure against the back of the perforated shower disk 43. When an excess of water pressure builds up in the water chamber 45, separate water streams are ejected from the front of the showerhead 29 when turned on, the force and diameter of such individual shower streams being proportional to the size of the orifices in the perforated disk 43 and the back pressure in the showerhead water chamber 45.

Figure 5:
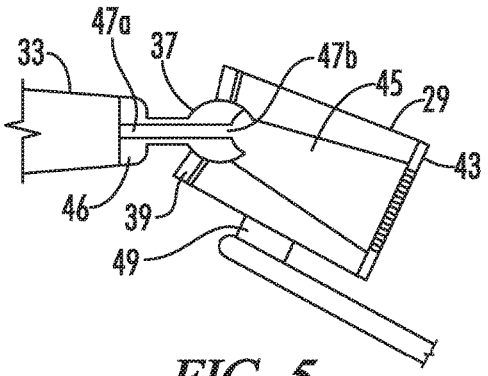
FIG. 5 is a view similar to FIG. 4 in which the showerhead is inclined downwardly, but water is still able to flow to or reach the spray screen at the front of the showerhead to provide a shower spray.
Figure 3:
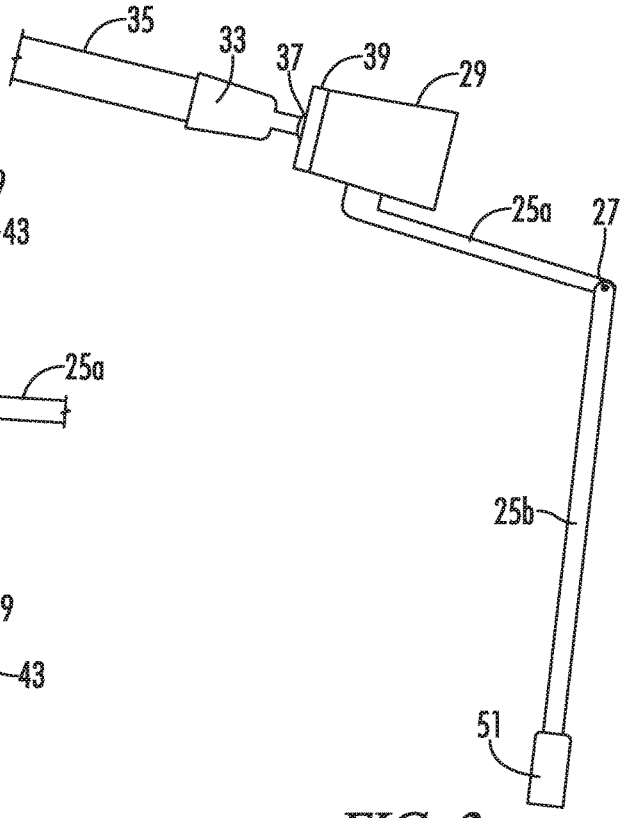
FIG. 3 is a view similar to FIG. 2 showing the control handle folded down as when the shower is not occupied or when occupied by an individual able to shower while standing.

In the center of the front surface of the shower ball 37 is a diverging orifice 47 expanding toward the perforated showerhead plate 43, and in the face of the shower ball 37 is a vertically expanded water passage 47 in which portion 47*a* will usually be a nearly circular orifice extending through the head of the coupling 33 and through the neck 46 of the shower coupling 33 and portion 47*b* will be a partially expanded opening of the same passage 47 in the outer face of the shower ball 37. See FIGS. 4 and 5 in which the rear of the showerhead 29 is aligned with the vertically expanded orifice 47*b* in the face of the shower ball 37 and FIG. 5 shows the showerhead 29 tipped downwardly but with the lower portion of the vertically expanded orifice on the face of the shower ball 37 still aligned with water orifice 41 of the showerhead 29. By such arrangement, it will be evident that when the showerhead is turned downwardly, the water flow can still gain access to the water chamber 45 and, if the opening in the shower ball 37 lined up with the water orifice 41 in the showerhead is extensive enough to allow enough water to enter the water chamber 45, compared to the amount that can pass through the perforated plate 43 and if the water pressure normally generated in the water chamber 45 by the back pressure generated by the perforated water plate 43, a shower spray will still be generated.

A shower adjustment arm 25 in two pivoted together portions 25*a*, preferably rigidly attached to or integrated with the showerhead 29 through a bracket at the proximal end of the adjustment arm aid, and 25*b*, constituting the distal portion of the adjustment arm 25, the end or extreme distal end of which will be grasped by the shower user, see FIG. 1, to control the inclination of showerhead as well as the water flow and will during nonuse of the shower or during showering by an individual who is not physically challenged, be pivoted straight downwardly. A rubber or other flexible or soft cushioning end 51 may be provided on the end of the outer or distal portion 25*b* of the adjustment and operating arm 25 to aid the user in grasping and retaining a grip on the arm 25.

Figure 6:
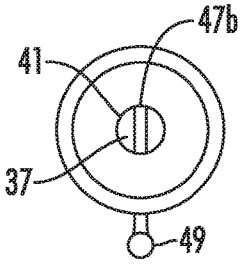
FIG. 6 is a front view of the showerhead with the spray plate removed and the water in a full flow position.
Figure 7:
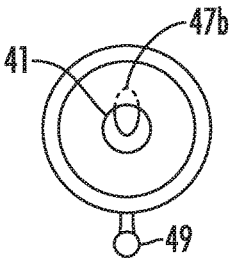
FIG. 7 is a front view of the showerhead as shown in FIG. 6 with the water in a restricted flow position.
Figure 9:
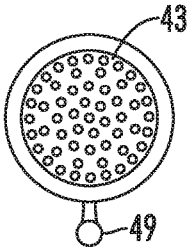
FIG. 9 is a front view of the showerhead with the spray plate installed.

In FIG. 6 there is shown an end view into the showerhead 29 with the perforated plate 43, as shown in FIG. 9, removed and the outline of the essentially circular rear inner portion or opening 41 of the showerhead overlapping, as shown, the vertically elongated distal end 47*b* of the orifice 47 extending through and to the end of the shower coupling 33 plus through the coupling neck 46 and then through the shower ball 37 and elongated in a vertical dimension near and at the surface of the shower ball 37. In FIG. 7 the end of the showerhead is shown when the showerhead has been declined downwardly so that only the lower portion of the vertically expanded orifice portion 47*b* is overlapped with the rear end of the water orifice 41 still, however, allowing the flowing water under pressure from the supply pipe 35 to flow from the lower portion of the expanded orifice 47*b* into the rear of the water chamber 45 in the showerhead. As explained in connection with FIG. 5, this still allows sufficient water under pressure from the supply pipe 35 to enter the water chamber 45 in the showerhead to provide pressure within the chamber 45 when the perforated plate is in place sufficient to form multiple streams of water from the showerhead for bathing or showering.

Figure 8:
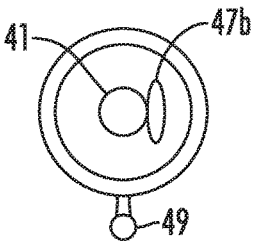
FIG. 8 is a front view of the showerhead as shown in FIGS. 6 and 7 in which the water flow is shut off by turning the showerhead to the side by means of the control handle.

FIG. 8 is a front view of the showerhead when the water flow is shut off by turning the showerhead to the side by means of the handle. FIG. 9 is a front view of showerhead 29 showing the perforated shower dispersion plate 43 attached to the showerhead, usually by means of a flange screwed into threads on the interior or sometimes the exterior of the showerhead 29. FIG. 9 is presented merely to show the usual forward appearance of the showerhead.

Figure 10:
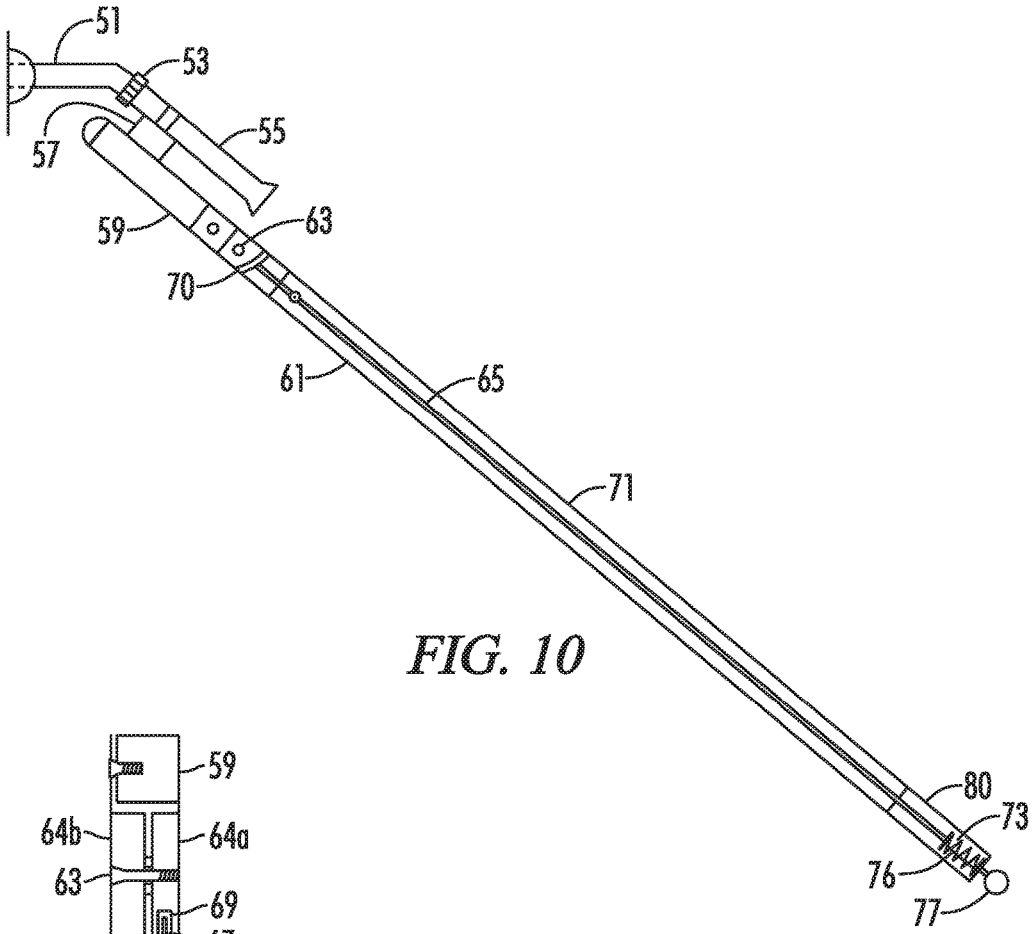
FIG. 10 is a side view of another embodiment of the showerhead and control handle arrangement of the invention in which the pivoting handle is formed of corrosion resistant tubular sections.
Figure 11:
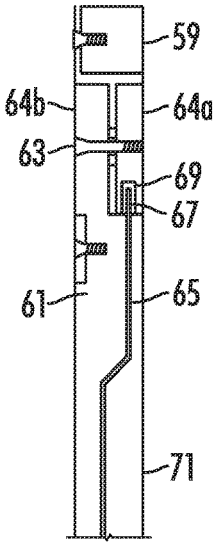
FIG. 11 is a partial top view of the control handle shown in FIG. 10 illustrating the handle pivot arrangement.

FIG. 10 is a side view of an alternative embodiment of a shower equipped with a showerhead adjustment arm in accordance with the invention in which the adjustment arm is formed in one embodiment of a thin metal or plastic rod mounted in a pivoting bracket secured to a mounting upon a more linearly designed showerhead than illustrated in the previous figures. In this construction the linearly designed showerhead 55 is pivotally mounted upon a wall mounted shower supply pipe 51 having an approximately forty-five degree curve near its outer end by a coupling 53. A mounting bracket 57 is connected to showerhead 55 to which bracket 57 is mounted in turn a stationary arm attachment member 59 to which a movable arm attachment member 61 is pivotably attached. The arm attachment members 59 and 61 may be formed of a sturdy plastic material such as polyurethane, acrylic plastic, or other material such as stainless steel which is resistant to degradation by water or air. As shown in FIG. 11, members 59 and 61 are pivotably connected together or with respect to each other by means of a stainless steel pivot bolt 63 passed laterally through mating ends 64*a* and 64*b* on members 59 and 61. A stainless steel rod 65 is housed in a longitudinally extending passageway in tubular member 71 of movable arm attachment member 61, and is secured to be longitudinally movable so that one end 67 can pass outwardly through an opening in the end of attachment member 61 connected to stationary member 59. As shown in FIG. 11 end 67 of rod 65 is oriented so as to extend into a complementary recess 69 in the end 64*a* of the stationary arm attachment member 59 when stationary attachment member 59 and movable arm attachment member 61 are vertically aligned with each other, thereby securing attachment member 61 in an extended use position as shown in FIG. 10. The intersection 70 between the movable attachment member 61 and the stationary attachment member 59 is complementarily curved to allow the movable attachment member 61 to rotate on its pivot 63 about the stationary attachment member 59 when end 67 of rod 65 is not extended into recess 69 in stationary attachment member 59.

As best shown in FIG. 11, the stainless steel rod 65 in the illustrated embodiment is bent to the side near its upper end as shown to bring it preferably to the center of an outer tubing member 71 comprising part of attachment member 61. A stop rod 76 is mounted to the outer or lower end of rod 65 in tubular member 71, the outer end of which stop rod 76 extends through an opening on the lower end of tubular member 71. A coil spring member 73 is secured over stop rod 76 which continually urges opposite end 67 of rod 65 out of tubular member 71 as shown in FIG. 11. In addition, a ring member 77 or other handle member is attached to the outwardly extending end of stop rod 76 which can be grasped by the user and pulled outwardly which will cause rod 65 to travel longitudinally outwardly in tubular member 71 so that end 67 of rod 65 is released from recess 69 of the stationary arm attachment member 59, allowing tubular member 71 to freely pivot. A gripping member or handle 80 is also provided on the outer end of tubular member 71.

Figure 12:
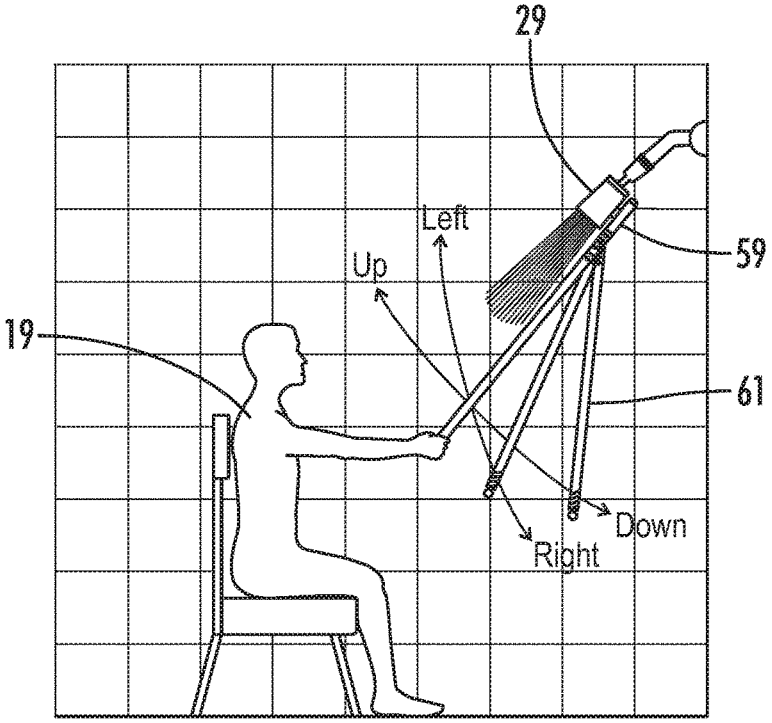
FIG. 12 is a diagrammatic side view illustrating use of the shower handle of the invention to control the position of a showerhead by an individual sitting in a chair within a shower enclosure.

As may be readily perceived the arm 61 including the stainless rod 65 and the outer stainless tubing 71 when unlocked will normally be pivoted downwardly by the influence of gravity, but will be light and easy to pivot manually into and locked in an extended position as shown in FIG. 10 by a seated individual taking a shower as shown in FIG. 12 which is a diagrammatic representation of the lower portion of the handle or attachment arm 61 being in such diagrammatic representation held by an individual 19 taking a shower while seated on a light chair as shown also in FIG. 1. In addition, when released by the individual, the handle or attachment arm when unlocked may be swung down to be in an out of the way vertical position as shown in FIG. 13 again in diagrammatic form so that an individual who is not physically challenged can take a stand up shower with the shower handle hanging down out of the way.

Figure 13:
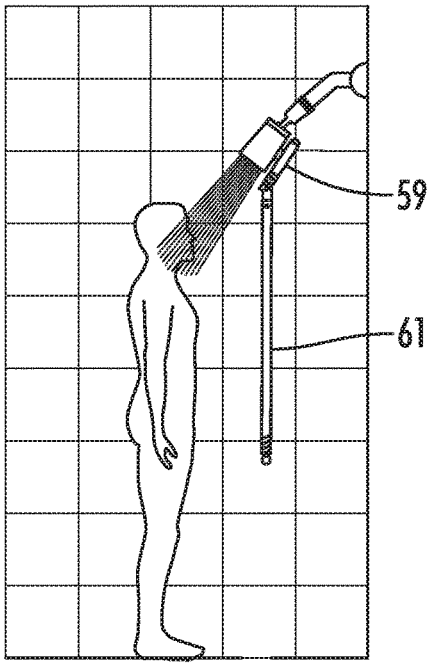
FIG. 13 is a diagrammatic side view of a typical physically unchallenged individual standing in a shower enclosure with the shower handle hanging down or dependent out of the way during such individual's shower ablutions.

Diagrammatic FIG. 12 also includes directional arrows indicating that handle 61 can be swung up to the position shown in FIG. 10 for grasping by a seated physically challenged individual plus swung down out of the way to enable use of the shower by an individual as shown in FIG. 13 who is physically unchallenged or may be swung from a central position in which water in one embodiment flows through or is ejected from the showerhead 29 to a side position where water flow may be limited. In addition, the respective arrows also indicate that the handle 61 can be swung to the left or to the right to in each case initially direct the shower spray to the left or right and contact the showering individual either more on their left side or right side to obtain a thorough washing and rinsing.

Figure 14:
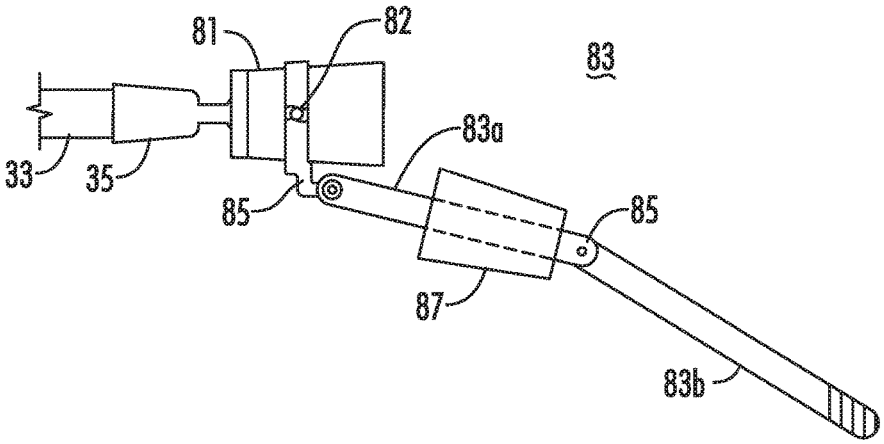
FIG. 14 is a diagrammatic view of another embodiment of the control handle of the invention.
Figure 4:
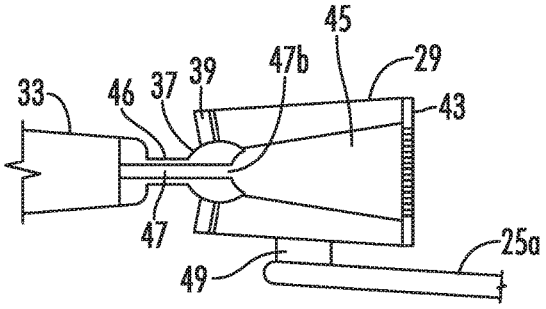
FIG. 4 is a cutaway view of a showerhead equipped with the control handle shown in FIGS. 1-3 in which the flow of water is adjustable.

FIG. 14 shows a further embodiment of the invention that or in which the shower arm 83 is attached to a conventional showerhead by preferably a metal strap arrangement 81 with a buckle 82 which holds a simple bracket 85 to the bottom of the showerhead, to which bracket is pivoted a two-piece arm 83 having an upper section 83*a* and lower section 83*b* with a pivot 85 between the two sections. A rigid sleeve 87 can be slid on the arm 83*a* down partially over the lower arm section 83*b* to hold the two sections in straight alignment with each other or may be kept over a single section so that the positioning of the handle in the hand is more comfortable. Since the handle 83 and bracket 85 are designed for use on a standard shower which will not have an internal arrangement for shutting off the water spray by turning the showerhead to the side, the handle construction need only be sufficiently rigid to vary the direction of the shower spray. Rather than using a simple buckled strap over the showerhead to connect the bracket 85 to the showerhead, a flexible bonnet of some type may be secured over the showerhead with end pieces adapted to be drawn tight against the inner and outer ends of the showerhead. At least section 83*b* and also section 83*a* may be pivoted out of the way when the handle 83 is not in use.

As will be understood from a reference to the above description and the appended drawings, it will be recognized that the arrangement of the invention provides a very effective yet inexpensive arrangement for adapting a standard shower to use by a physically challenged individual who nevertheless prefers to shower by himself or herself.

While it might be thought that having a pivot connection in the handle 85, which handle serves to control the direction of the showerhead and therefore the direction of water flow from such showerhead, would be undesirable due to unwanted bending or pivoting of such handle while controlling the direction of flow or the flow by inclination of the showerhead, in actuality it has been found that, while a universal pivoting arrangement might well provide difficulty, a single direction pivot causes minimal difficulty, since the connection from the hand controlled end of the directional control rod to the end attached to the showerhead can be either applied transversely to the pivot joint or can be partially pivoted and pressure or force from the end applied through the pivot joint against the end of the other section of handle at an angle with such section in which case the two way cross linkage or pivoting linkage serves as a lever arm to increase force applied to the showerhead. It has been found that average disadvantaged persons learn the necessary hand moves to accomplish such control amazingly quickly and no difficulty has been encountered with physically challenged individuals learning the necessary hand movements to control directed orientation of the showerhead even to the extent of partially or completely obstructing flow of shower water through such showerhead.

The invention of the present application can, as will be evident, be practiced by various apparatus comprising slightly different embodiments all operating in a related manner. FIGS. 15-19 illustrate another embodiment of the invention, in which the shower fitting of the invention is attached to the water supply pipe 103 by a ball type connecting fitting 105. A screw-tightened locking clamp or wall pipe support 107 is secured around water supply pipe 103 with its inner surface flush against wall W, and with a tac rubber 108 or other material such as a putty or adhesive applied to aid in maintaining a connection with the wall. It will be evident that clamp or pipe support 107 will aid in preventing supply pipe 103 from pivoting or being pulled out of wall W due to the extra stresses exerted on pipe 103 as a result of manually twisting and turning the showerhead 109 using the handle apparatus 100 in accordance with the present invention. More particularly, handle attachment 100 includes an L-shaped mounting section 111 which is connected to pipe section 112 positioned between fitting 105 and showerhead 109, and a pivotable attachment arm 113 which is pivotably secured to an end of mounting section 111. As in the embodiment described above with respect to FIGS. 10-11, attachment arm or handle 113 includes a spring-loaded finger latch 115 which is connected to an internal rod 117 extending longitudinally through handle 113 by a connector 119. End or tip 121 is oriented to be inserted into one of the recesses 123, 125, and 127 in mounting section 111, which recesses are positioned at different angles, and thus enable the handle 113 to be locked at a plurality of different use or non-use angles by pivoting handle 113 on its hinge or pivot connection with mounting section 111 and then releasing finger latch 115 so that end 121 extends into the selected recess 123, 125, or 127. By pulling with shower control extension arm 113 by the finger latch 115 against the bias of the spring of connection 119 the connection of the arm 113 with the mounting block 111 may be established or disestablished. This procedure may be easily carried out by a disabled person while sitting in a tub on a bath seat.

Figure 15:
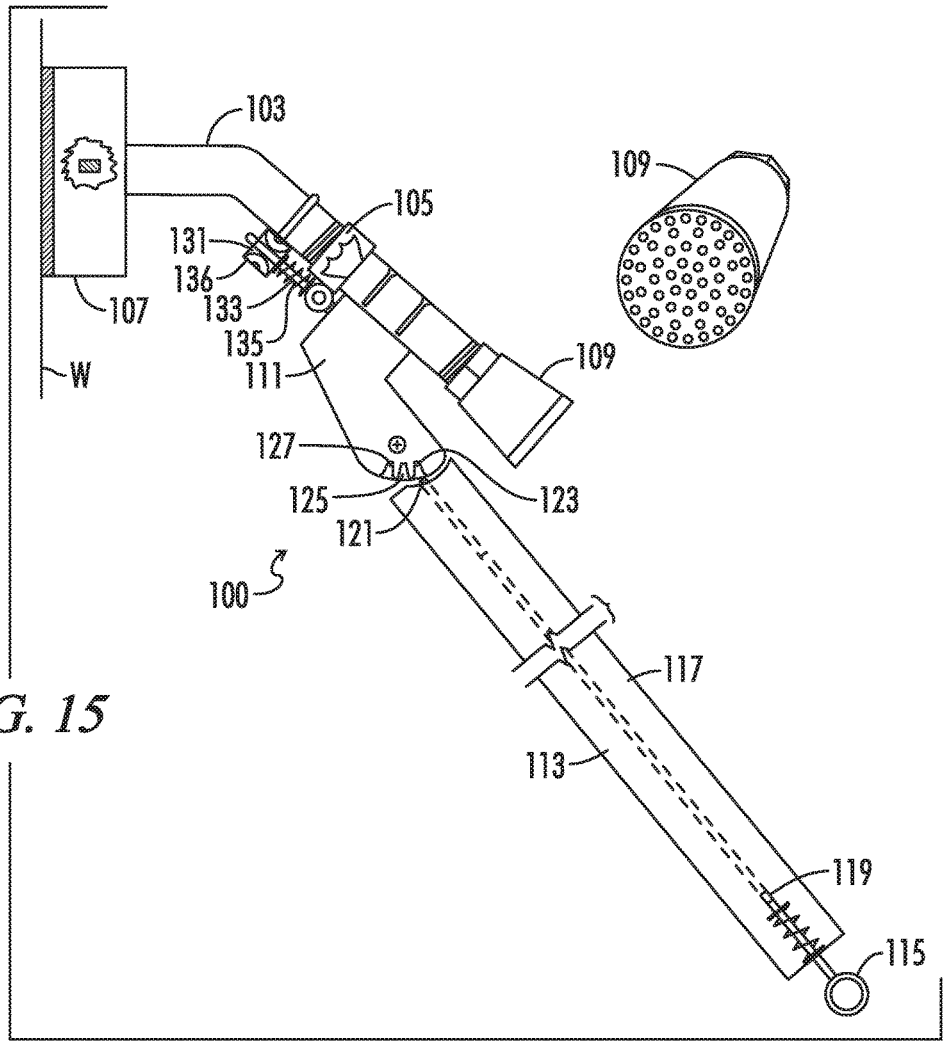
FIG. 15 is a side view of another embodiment of the showerhead control handle assembly of the invention in which the handle is lockable in multiple alternative use positions and including a balance support.
Figure 16:
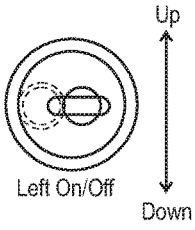
FIG. 16 illustrates a first valve gate position.
Figure 17:
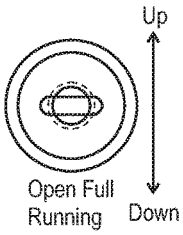
FIG. 17 illustrates another valve gate position.

The presently described embodiment also includes, as illustrated diagrammatically in FIGS. 15, 16 and 17, a means for varying the water flow through ball-type connecting fitting 105. More particularly, depending upon the position of fitting 105 with respect to the connecting end of supply pipe 103, allows full flow with a full on central orientation as shown in the middle view FIG. 16 but cuts the water flow either completely off or very substantially off as the showerhead is turned either to the left (FIG. 15) or to the right (FIG. 17) with respect to a central position (FIG. 16).

Figure 18:
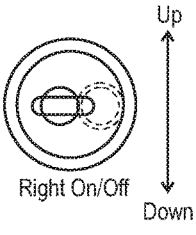
FIG. 18 illustrates a third valve gate position.
Figure 19:
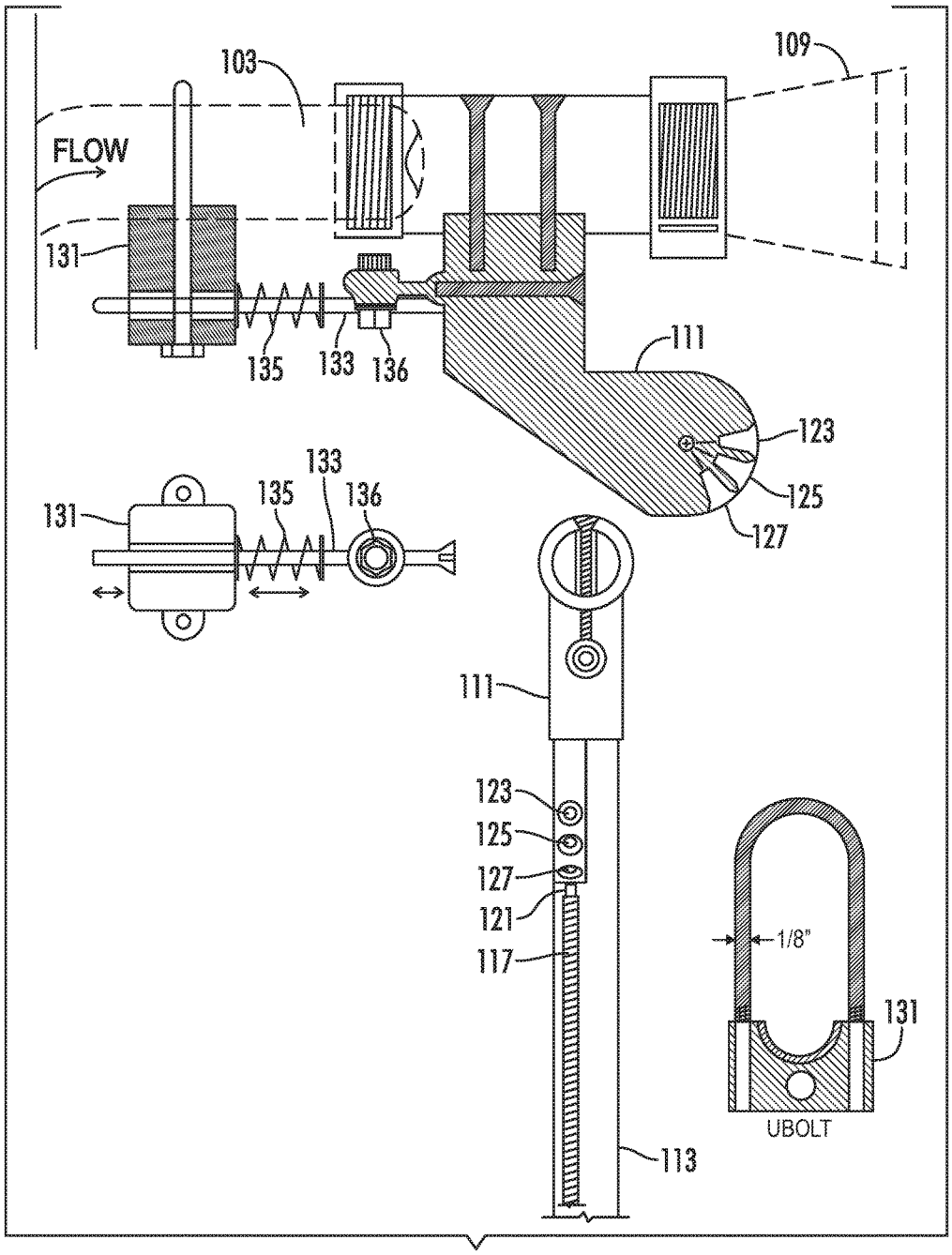
FIG. 19 is a side and front sectional view of the embodiment shown in FIG. 18.

In addition, as best illustrated in FIGS. 18-19, another bracket member 131 is secured directly by a clamping means or other arrangement to inflow pipe 103. A rod member 133 is connected to bracket member 131 on one end so that its other end is slidable within an aperture in mounting section 111. A coil spring 135 is provided over rod member 133, and a threaded knob means 136 is provided for adjusting the distance rod member 133 is able to extend into the aperture in mounting section 111. The knob means 136 is used to vary this setting, which essentially comprises an interlock which can be used to lock the shower head in the on position by use of the spring biased locking rod member 133. In one extreme, a full pivoting of the showerhead is allowed, while in another extreme, the showerhead may be locked against pivoting while the water flow is locked in a full open position. By connecting spring biased rod 133 between bracket member 131 and mounting 111, in addition, when the handle 113 is utilized to vary the direction the showerhead 109 is pointing, all of the stress of such twisting exerting on the inflow pipe is redirected through rod 133 and bracket member 131, and away from the wall connection of the inflow pipe. As a result, this balance support connection results in significantly less wear or stress on inflow pipe 103, and thus prevents loosening, cracking of such pipe, which it has been found may become so loose as to leak or even become completely dislodged, which it will be immediately evident can result in significant water damage occurring. This arrangement in particular can be used with or without the flow control system.

Figure 20:
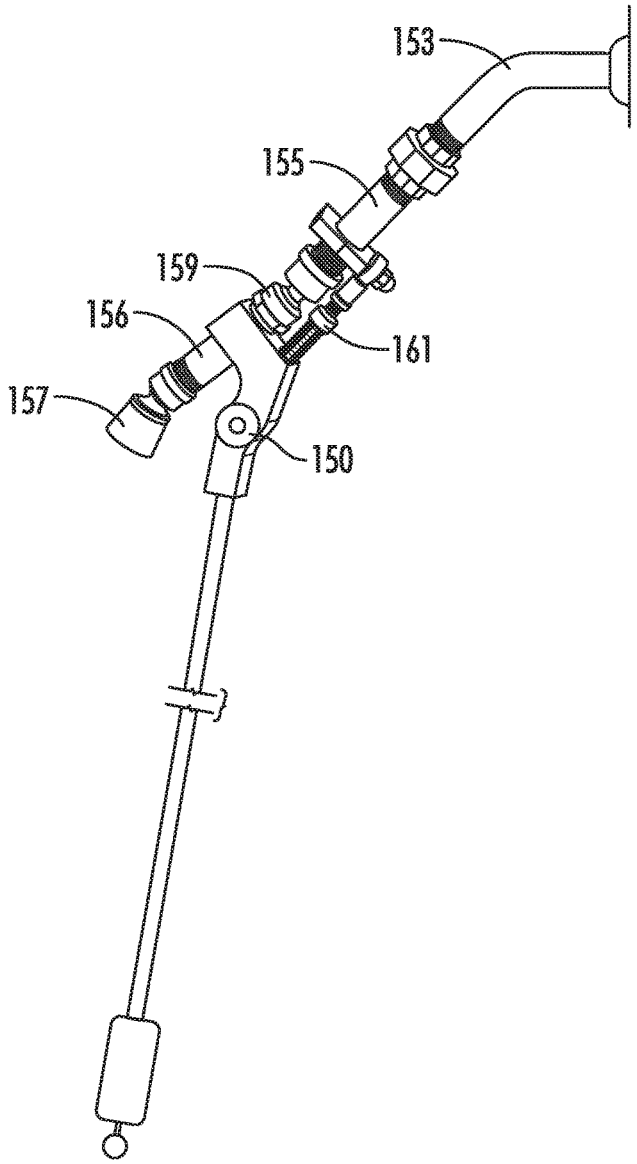
FIG. 20 is a somewhat angled side view of a preferred embodiment of the showerhead control handle assembly of the invention having a modernistic and attractive chromed design for use in both tub-shower and shower only installations.
Figure 21:
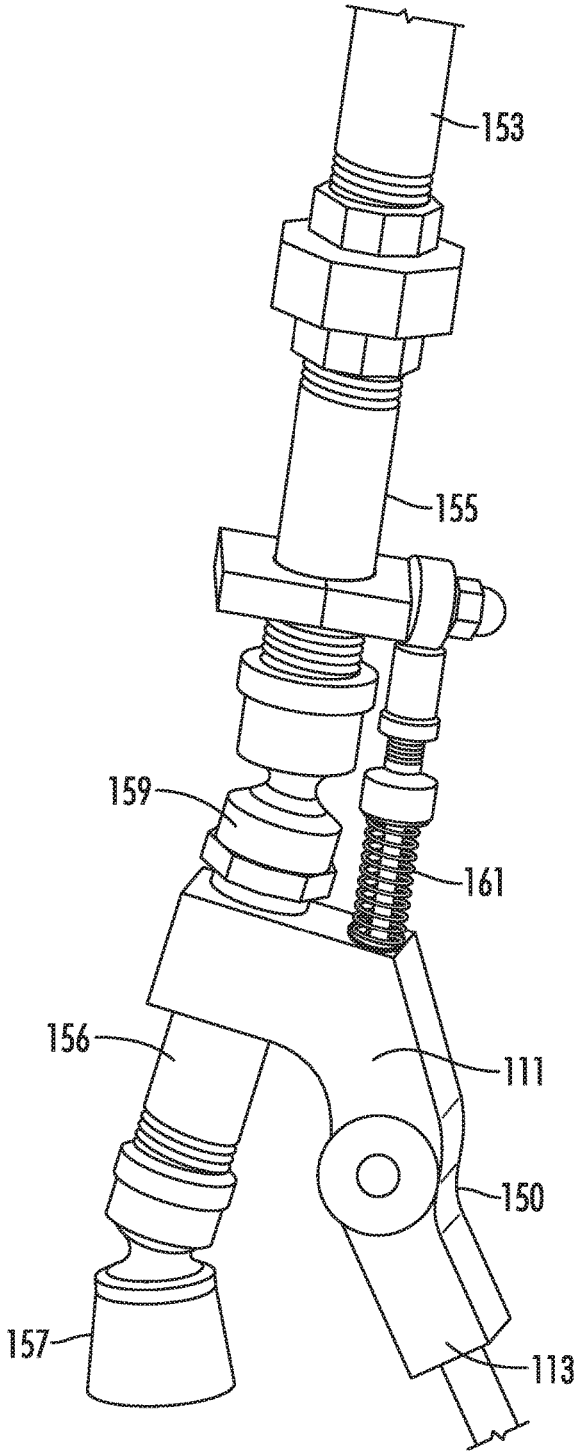
FIG. 21 shows an overall view of the plumbing portion of the showerhead control handle assembly shown in FIG. 20.

FIG. 20 is a full scale view of a preferred embodiment of the showerhead control handle or arm assembly of the invention, including the entire shower arm representation, and FIG. 21 illustrates details of the shower fitting assembly leaving out the shower arm to better fit the entire depiction in a larger scale drawing. It will be noted that the embodiment shown in FIGS. 20 and 21 has been designed to be made of in general fewer and simpler parts engineered to fit and be held together in a cleaner cheaper design as shown.

The embodiment shown in FIGS. 20-21 is a somewhat different representation of a showerhead adjustment arm 150 and shower fitting nozzle support as compared to earlier embodiments although the arrangement is generally similar between the various designs and the mechanical design and arrangement is generally similar in its broad outline of arrangement and design to be pleasing to the aesthetic senses as well as being effective and practical. The shower assembly includes a central connecting section 155 connecting between supply pipe 153 and lower pipe section 156, to which showerhead 157 and central head or mounting section 111 of shower adjustment arm 150 are connected.

As will be understood, the supply pipe, or water supply pipe, 153 serves through the connecting fittings or sections 155 and 156 to connect the entire shower fitting 157. The inlet section 153 to the spray nozzle 157 is secured to connecting fitting 155 by a flexible water tight connection 159 and the connecting sections 155 and 156 and arm assembly 150 are supported or held flexibly by the spring adjustments and connection arrangement 161 which is helically in effect connected together. The control support spring connection arrangement 161 is similar to that in the previously described embodiment and serves to strengthen the overall shower assembly, and in particular the attachment acts as a brace or support against which pivoting of the handle section and as a result the showerhead by the user causes the showerhead to pivot more easily and with less stress occurring on the water supply conduits. This arrangement thus achieves vastly superior results in terms of extending the lifespan of the assembly by allowing less wear on the pipe connections to occur as they are stressed by use of the shower handle, which stress is variable depending upon the flexibility and type of joints of the connections, but which nevertheless in all cases is significant.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention.

The invention claimed is:

1. An economical shower apparatus for assisting physically challenged individuals to shower while seated comprising:

a directional adjustable handle for a showerhead assembly having a nozzle, said handle including a mounting section and an adjustment arm pivoted to each other, said mounting section being connectable to the showerhead assembly such that the direction of water flow from the nozzle can be varied by an occupant of the shower in a seated position manually altering the position of the adjustment arm, an outer surface of the mounting section including one or more spaced-apart recesses, and the adjustment arm including an internal rod extending longitudinally and being longitudinally movable in the adjustment arm and having an end portion which is oriented and biased to selectively extend into one of said recesses in order to secure the adjustment arm against pivoting with respect to the mounting section, such that the adjustment arm extends at a nonvertical angle and is within reach of the shower occupant, the pivot of the adjustment arm to the mounting section being through a horizontal pivot enabling the adjustment arm to be pivoted to a substantially vertical orientation out of the way of a shower occupant using the shower in a stand-up shower mode.

2. A shower apparatus in accordance with claim 1 additionally comprising a coupling for connecting the showerhead assembly to a water supply pipe.

3. A shower apparatus in accordance with claim 2 in which said means for securing the adjustment arm against pivoting comprises a locking arrangement enabling the adjustment arm to be locked at different angles with respect to the mounting section.

4. A shower apparatus in accordance with claim 3 additionally comprising an adjustable spring connection secured between the water supply pipe and the mounting section, said spring connection reducing the amount of stress exerted on the water supply pipe when the showerhead assembly is pivoted using the adjustment handle.

5. A shower apparatus in accordance with claim 4 in which said adjustable spring connection includes a spring-loaded rod member which is length adjustable with respect to the mounting section.

6. A shower apparatus in accordance with claim 5 additionally comprising a ball valve gate situated upstream from the showerhead assembly which allows for manual adjustment of amount of water flow by changing the angle of the showerhead assembly using the directional adjustable handle.

7. A shower apparatus in accordance with claim 1, additionally comprising a spring loaded finger latch secured to the rod.

8. A shower apparatus in accordance with claim 7 additionally comprising a tubular connection between the water supply and shower head to which the mounting section is secured.

9. A shower apparatus in accordance with claim 8 in which the nozzle is secured to one end of the tubular connection.

10. A shower apparatus in accordance with claim 9 additionally comprising an inlet section which is secured on one end to the tubular connection and is adapted to be secured on the other end of a water supply pipe.

11. A shower apparatus in accordance with claim 10 additionally comprising an adjustable spring connection extending between the inlet section and mounting section of the adjustable handle.

12. A shower apparatus in accordance with claim 11 additionally comprising a pipe support, said pipe support secured to the water supply pipe and to a wall surface from which the water supply pipe extends.

13. A shower apparatus in accordance with claim 1 in which the mounting section is secured to a downwardly facing surface of the showerhead assembly.

* * * * *